US008243963B2

(12) United States Patent
Gladwin et al.

(10) Patent No.: US 8,243,963 B2
(45) Date of Patent: Aug. 14, 2012

(54) SWIVEL TWEETER MECHANISM FOR A CONSTANT PHASE COAXIAL ACOUSTIC TRANSDUCER

(76) Inventors: Timothy A. Gladwin, Pakenham (CA); Christopher I. Carlisle, Amprior (CA); Shawn Luimes, Stittsville (CA); Robert G. Johnston, Amprior (CA)

( * ) Notice: Subject to any disclaimer, the term of this patent is extended or adjusted under 35 U.S.C. 154(b) by 366 days.

(21) Appl. No.: 12/456,542

(22) Filed: Jun. 18, 2009

(65) Prior Publication Data

US 2010/0322457 A1 Dec. 23, 2010

(51) Int. Cl.
*H04R 25/00* (2006.01)

(52) U.S. Cl. ..... 381/182; 381/186; 381/387

(58) Field of Classification Search ..... 381/86, 381/87, 332, 182, 186, 386, 387, 390, 395; 181/144, 145, 147, 153, 154, 199
See application file for complete search history.

(56) References Cited

U.S. PATENT DOCUMENTS

| | | | | |
|---|---|---|---|---|
| 5,133,428 | A | 7/1992 | Perrson | |
| 5,739,480 | A * | 4/1998 | Lin | 181/144 |
| 5,859,917 | A | 1/1999 | Silber et al. | |
| 6,002,780 | A | 12/1999 | Espiritu | |
| 6,070,694 | A | 6/2000 | Burdett et al. | |
| 6,101,262 | A | 8/2000 | Haase et al. | |
| 6,356,640 | B1 * | 3/2002 | Lin | 381/182 |
| 6,683,963 | B2 | 1/2004 | Sterns et al. | |
| 7,121,756 | B2 | 10/2006 | Wright et al. | |
| 7,178,628 | B2 | 2/2007 | Gordon | |

* cited by examiner

*Primary Examiner* — Huyen D Le

(57) ABSTRACT

An audio transducer assembly configured for positioning with respect to a mounting surface, said assembly employing a tweeter in a directionally adjustable body which swivels radially and axially for positioning and directing the tweeter in a desired direction. By keeping the center of rotation at or near the center of the surface of the tweeter, the adjustment of the tweeter does not significantly offset its body in the X or Y direction through its range of motion. Such configuration allows for compensation of the distortion caused by placing the tweeter in the middle of a woofer in a speaker having multiple transducers in a single assembly.

15 Claims, 4 Drawing Sheets

SWIVEL TWEETER MECHANISM FOR A CONSTANT PHASE COAXIAL ACOUSTIC TRANSDUCER

I. FIELD

The present disclosure is generally related to audio transducers used for sound generation and reproduction. More particularly, the present disclosure is directed to positionable audio speakers.

II. DESCRIPTION OF RELATED ART

Audio transducers (also known as and equivalently referred to as "speakers") have been a staple of consumer and industrial electronics for some time. First introduced as sound delivery tools, the basic premise of such transducers is the movement of air or gas through a medium driven by a coil and a magnet. An electrical signal modulated by an audio signal changes the position of the coil about a magnet and drives the medium to move the air, thus reproducing the audio signal generated or captured at another location.

As the audio transducer art progressed, it addressed the desire and need for higher quality reproduction. Stereo and multiple signal and audio transducer systems created a more realistic sound environment, adding direction and depth to the listening experience. Audio transducers improved in quality as well. Scientists have been perfecting the art of audio reproduction by using better and different materials, structures and combination to provide a more realistic and higher quality sound reproduction, which to this date is primarily based on the movement of air by electromagnetical assemblies and components.

One of the improvements in the audio transducer art is the segregation of lower and higher audio signals. The industry recognized that the physical requirements for higher quality low-end audio signals generated by the so-called "woofers" introduce limitations on the higher end of the audio spectrum generated by the "tweeter." Similarly, audio transducers that are designed for optimized higher frequency audio signals are not optimized for low-end sound generation. Accordingly, the audio transducer industry split the delivery of such signals between two or more audio transducers, thus allowing each of the audio transducers to produce a portion of the overall sound content within its optimized configuration.

In time, the industry recognized the need for aesthetic and placement accommodation and sought seamless integration into complex environments. Speakers evolved into integrated placement in entertainment centers, ceilings, walls, car compartments and other electronic devices. As such, the placement of the speakers often compromised the sound fidelity, as many locations are suboptimal for high fidelity audio reproduction. To address this deficiency, the industry introduced adjustable high frequency audio transducers. Such adjustable devices allowed the user to direct or adjust the sound flow toward the "sweet spot" or the targeted listening area. However, as will be described in further detail herein, when a tweeter is placed in the audio field of a woofer, the tweeter may interfere with the fidelity of the woofer.

Prior-art swivel tweeters typically place the center of rotation behind the tweeter radiating surface. This causes several deficiencies in the high and mid frequency performance as the tweeter is swiveled. More particularly, in the prior art, when the tweeter position is adjusted with respect to the woofer, the tweeter output frequency, its phase response, woofer output frequency, tweeter-woofer sound pressure level and phase interactions change.

Most prior art swivel tweeter mechanisms place the center of rotation at the base of the tweeter, at its end closest to the woofer. Such placement provides efficiency in manufacture and a substantial range of angular movement. However, in the downside, the center of the tweeter changes with its position relative to the woofer. Consequently, the angular and radial displacement is substantial. Such movement has an undesirable affect on the amplitude and phase relationship of sound energy from the tweeter with respect to sound energy from the woofer, making it difficult or impossible to design a single compensating network or crossover for all tweeter positions.

Further, the typical prior art swivel tweeter affects the sound radiation pattern and amplitude from the woofer. As the tweeter is swiveled, its body moves closer to the woofer diaphragm on one end and further on the other. This affects both the acoustic loading and the sound radiation pattern of the woofer diaphragm. As before, because the acoustic loading and sound radiation pattern from the woofer diaphragm is a complex function of the tweeter position, it is difficult to design a single or cost effective compensating network for all tweeter positions.

Diffraction is also a notable side effect of adjustable components in a speaker. When sound waves emanate from a speaker every change in surface they encounter (a bump, edge or ridge) causes the waveform to reflect and re-radiate. This is a form of acoustic distortion called "diffraction." Diffraction causes frequency response errors and other audible problems mostly in the midrange and high frequency areas that can make the speaker sound "boxy" and "nasal." Given a static obstruction, audio engineering is able to compensate for obstacles. However, when the obstacles are dynamic, compensation is more complicated or impractical. Diffraction also has an adverse effect on broad, even dispersion. For example, U.S. Pat. No. 7,178,628B2 (the "'628 patent") describes a tweeter that swivels about a point in space in front of a speaker diaphragm in order to reduce sound reflection from the speaker housing. However, in this design, even slight amounts of tweeter swivel will cause asymmetric changes in the diffraction of the high frequency sound field from the edges of the tweeter support. Further, the method disclosed in the '628 patent will cause the geometric center of the front surface of the tweeter diaphragm to move with respect to the geometric center of the low frequency diaphragm when the tweeter is swiveled. These inherent characteristics produce phase and amplitude interactions between the high frequency transducer sound field and the low frequency transducer sound field that vary with the tweeter positions. Such architecture makes it difficult or impossible to design of a high performance, compensating network.

Similarly, in the prior art adjustable tweeter assemblies, the acoustic profile of the tweeter changes from the point of view of the woofer, and the tweeter edge profile changes throughout its range of adjustment. As the tweeter swivels in prior art "ball-in-socket" designs, typically the edge geometry around the tweeter radiating surface changes. Such configurations cause undesirable changes in the radiated sound pressure level due to diffraction at the corner geometry. This limitation is evident in U.S. Pat. Nos. 5,133,428 and 6,683,963.

Another significant limitation of prior art coaxial speakers is the airflow between the tweeter and the woofer. Namely, as the woofer drives air, the resulting airflow tends to produce undesirable acoustic byproducts as the air moves through the fittings and the mounting structure of the tweeter assembly. The undesirable byproducts are often perceived as hissing or whistling appearing at bass notes and large excursions.

Moreover, many prior art adjustable tweeters do not have sufficient mechanical stability to remain in a constant adjusted position in view of the inherent forces introduced by the vibration. Thus, over time the adjusted position changes and the fidelity sought by the user diminishes.

III. SUMMARY

The disclosed embodiments recognize the deficiencies presented by the prior art adjustable tweeters. Placing the center of rotation at the base of a tweeter body in a ball-socket configuration is advantageous for the wide range of motion and ease of manufacture. However, it also changes the acoustic center of the tweeter. As the tweeter rotates off-axis, the acoustic center of the tweeter moves laterally away from the woofer axis and the distance from the tweeter acoustic center to the woofer cone changes. Moving the acoustic center of the tweeter changes the phase and amplitude interactions between the tweeter and woofer. When the phase and amplitude interactions between the tweeter and woofer change with position, it is impossible for the manufacturer to design a high quality crossover. The crossover designer is forced to optimize the crossover with the tweeter in one position, typically on axis, and accept that the acoustic quality will degrade when the tweeter is moved.

The disclosed exemplary embodiments place the center of rotation of the adjustable tweeter at the surface of the tweeter, i.e. at the center of the tweeter's acoustic radiation, as opposed to its base. Accordingly, the relative position of the acoustic center of sound radiation from the tweeter is fixed with respect to the acoustic center of sound radiation from the woofer, allowing the acoustic designer to optimize a crossover for multiple or all positions of the tweeter without compromise. Moreover, the rounded diffraction edges of the disclosed adjustable tweeter assembly do not change as the tweeter is repositioned, allowing the acoustic designer to optimize a crossover for multiple or all positions of the tweeter without compromise.

Notably, the acoustic profile of the disclosed adjustable tweeter referenced to the woofer cone does not change as the tweeter is swiveled or adjusted and the obstruction it poses to the woofer is independent of the direction and amount of its position with respect to the woofer, once again contributing to the elimination of sound diffraction. Accordingly, the woofer sound field is constant over the range of tweeter movement, thereby allowing a compensating crossover design.

In another exemplary embodiment, a spring is disclosed as means for applying a force to hold the tweeter in the desired position regardless of the tweeter orientation or vibration forces exerted on the tweeter during its use. The disclosed embodiment provides sufficient force to maintain the tweeter in its designated position and resist the movement of the tweeter exerted by forces emanating from the sound energy produced by the tweeter and woofer and the ambient operating environment.

In another exemplary embodiment, a mechanism is disclosed to allow limited axial range of motion to prevent over twisting of wire leads connected to the tweeter. Disclosed embodiment uses a ring/stop configuration allowing two elements to each have a range of motion greater than zero degrees, but less than 360 degrees. In sum, the disclosed configuration provides a defined range of motion greater than 360 degrees and less than 720 degrees, which allows the user a full range of orientation for the tweeter, while maintaining the integrity of the wire leads.

In another exemplary embodiment a barrier means such as a barrier, seal and/or baffle, is/are utilized to minimize and/or eliminate the movement of air produced by bass notes through the tweeter assembly. Such means limits and/or eliminates perceivable air movement produced by the woofer through the tweeter assembly. As the reader will recognize, when a relatively large volume of air is moved through a relatively small opening, such movement may and often does produce an audio response, often a high frequency response. In the sound reproduction applications, such audio response is undesirable, as it is perceived by a listener as hissing or whistling coincident with low and midrange notes. Thus, the use of a barrier means to redirect, dampen or eliminate the airflow through the tweeter assembly improves the audio fidelity of the speaker.

Other aspects, advantages, and features of the present disclosure will become apparent after review of the entire application, including the following sections: Brief Description of the Drawings, Detailed Description, and the Claims.

IV. SUMMARY BRIEF DESCRIPTION OF THE DRAWINGS

V. DETAILED DESCRIPTION

Figure 1:
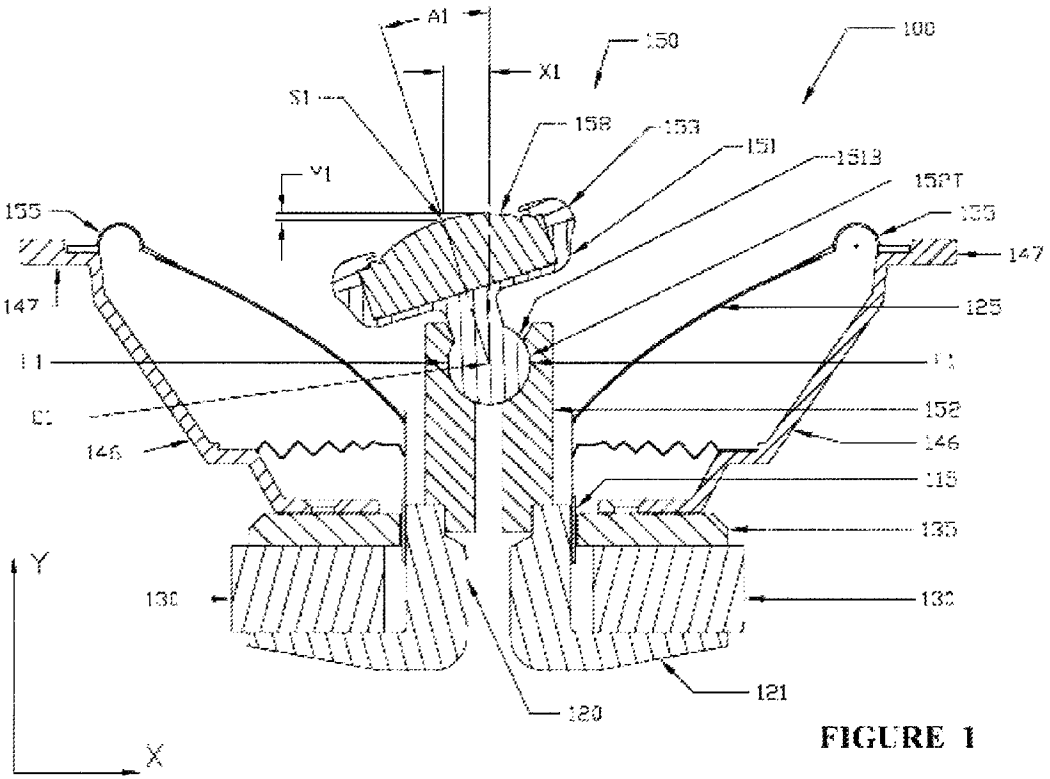
FIGURE 1 Prior Art
FIG. 1 is a prior art illustrative embodiment of a speaker having an adjustable tweeter residing within a diaphragm of an accompanying woofer.

Referring to FIG. 1, shown is a typical prior art adjustable tweeter 158 positioned in the center vicinity of a woofer-audio transducer, partially shown by a magnet 130 positioned next to a pole 120, and connected to a back-plate 121 at its bottom and front-plate 135 at its top. Voice coil 115 is positioned in the electromagnetic field of a magnet 130 and in between the front-plate 135 and the pole 120. An electrical signal representing an audio signal is connected to the coil 115. The current of the electrical signal changes the relative physical position of the coil 115 with respect to the magnet 130 and in turn drives a diaphragm 125, which is connected to the coil 115. The diaphragm 125 displaces the air thereby reproducing an audible signal.

The pole 120 supports a tweeter mounting post 152, which supports a tweeter assembly 150. The tweeter assembly 150 comprises a tweeter holder 151, which further comprises a base 151B at its bottom end and a tweeter waveguide 153 at its opposite, top end. A base 151B is shown in spherical form movably residing in a complimentary annular aperture 152T formed at the top end of the mounting post 152. A frictional force F1 maintains the base 151B in a user selected position within the annular aperture 152T. Accordingly, a user can orient the direction of the tweeter 158 by swiveling the tweeter assembly 150 about the mounting post 152.

The configuration of FIG. 1 has an inherent advantage of wide degree of axial movement and therefore orientation of tweeter 153 with respect to the woofer body. However, it has some significant disadvantages. One of the disadvantages is the instability of the directional position. The frictional force F1 holding the tweeter 153 in its oriented position degrades over time by inherent temperature variations, audio vibration, gravity and other environmental forces, especially when the assembly 150 is mounted in a mobile vehicle.

Another disadvantage inherent in this design, is that the tweeter assembly 150 can be continuously twisted about the y-axis without sufficient restriction. Accordingly, the leads connected to the tweeter 158 may sever from the tweeter 158 or become damaged if the user continues to rotate the tweeter 158.

Moreover, audio fidelity is also significantly compromised in the design of FIG. 1, as its center of rotation is toward the bottom C1 of the tweeter assembly 150. Shown is the angular movement A1 of the center S1 of tweeter 153. The reader will observe that in the present design, the center S1 is displaced from the center of speaker 100 as the tweeter assembly 150 is adjusted by the user. As result of the adjustment, the center S1 of the tweeter 158 is offset by a distance X1 in the X-direction and Y1 in the Y-direction. Such displacements are significant to the fidelity of audio reproduction of the speaker 100. If the displacement is substantially constant, audio engineering can compensate for the static obstruction by crossover circuitry. However, because the adjustments and orientation of the prior art tweeter assembly 150 are essentially infinite, it is difficult to compensate for all the variations and accordingly the audio fidelity of the speaker 100 designs suffers.

Figure 2:
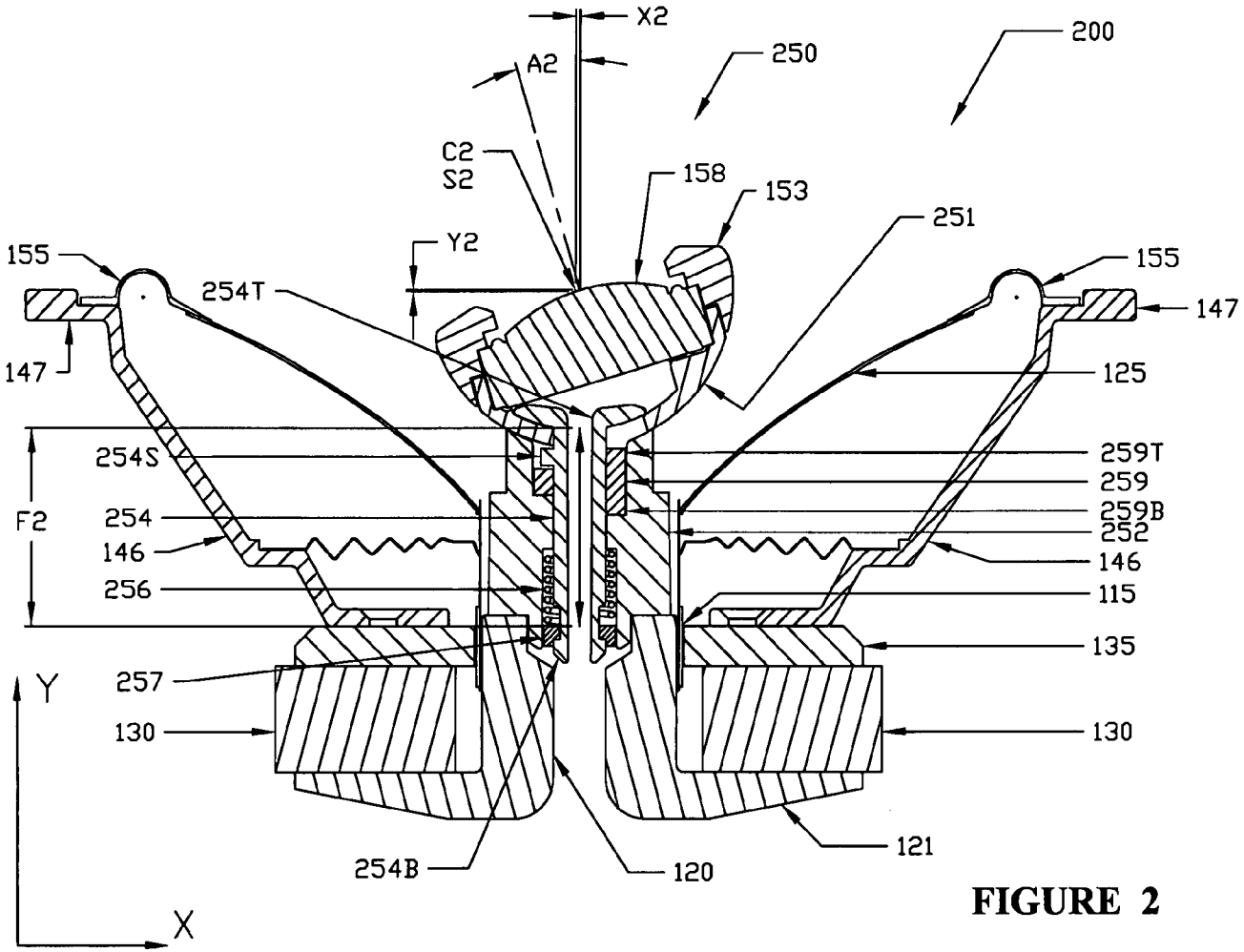
FIG. 2 is an illustrative embodiment of a speaker having an adjustable tweeter with center of swivel and rotation about its surface.

The embodiments of FIG. 2 overcome the limitations of the structure shown and described in FIG. 1. Overall, the disclosed embodiments and FIG. 2 recognize the significance of placing a center of rotation C2 at or near a center S2 of the tweeter 158. In this configuration, the Y-axis displacement Y2 and X-axis displacement X2 are minor and insignificant. As such, the distortion and interference caused by a tweeter assembly 250 placed in the audio path of a woofer can be compensated by a crossover network. As will be discussed in additional detail below, coupling the center of rotation C2 at or substantially coincident with the center surface S2 of the tweeter 158, presents a virtually static tweeter 158 position with respect to the woofer, and at the same time allows the user to radially and axially orient and adjust the tweeter 158.

FIG. 2 shows the tweeter 158 positioned substantially in the center vicinity of a woofer-audio transducer, comprising of the magnet 130 positioned next to the pole 120, and connected to the back-plate 121 at its bottom and the front-plate 135 at its top. The voice coil 115 is positioned in the electromagnetic field of the magnet 130 and in between the front-plate 135 and the pole 120. The front-plate 135 is connected to a frame 146 terminating at a mounting flange 147. A surround 155 is attached at the vicinity of the flange 147 at its one marginal side and to the diaphragm 125 at the other, thereby providing support and relative position for the diaphragm 125. An electrical signal representing an audio signal is provided to the coil 115 and/or its housing. The current of the electrical signal drives the relative physical position of the coil 115 with respect to the magnet 130 and in turn drives the diaphragm 125. The diaphragm 125 displaces the air thus reproducing the audible signal.

The pole 120 supports a tweeter mounting post 252, which in turn supports a tweeter assembly 250. The tweeter assembly 250 in part comprises a tweeter holder 251, the tweeter waveguide 153 and the tweeter 158. The tweeter 158 is positioned in the tweeter waveguide 153, which is attached to the holder 251. The holder 251 is positioned between a flange 254T and the top end of the mounting post 252 such that frictional force is exhibited between the flange 254T and the holder 251, and between the holder 251 and the top of the mounting post 252. The flange 254T is formed on the top end of the retaining post 254 to reciprocally match the inner surface of the tweeter holder 251. Similarly, the top of the mounting post 252 is formed to reciprocally match the outer surface of the tweeter holder 251. In combination, the tweeter holder 251 is positioned for a radial range A of motion 0 to A2 degrees, which effectively extends to −A2 to A2 degrees, as the holder 251 is axially rotatable in excess of 360 degrees. In one embodiment, it may be desirable to limit the range of motion to a range less than −A2 to A2 degrees in order to preserve the overlap of the top portion of the mounting post 252, the flange 254T and the holder 251. This effectively prevents air leaks and undesirable audible byproducts such as hissing or whistling effects commensurate with such air leaks. In other embodiments, one could define the range of motion from −A2 to A2 degrees and provide for alternate means to compensate for such air leaks. As can be seen by reference to FIG. 2, range of such radial motion can be designed by variation of the flange 254T in combination with the top dimension of the mounting post 252 and the tweeter holder 251. In combination, the tweeter holder 251 and the tweeter 158 have a full range of radial motion and directional adjustment.

Further, the tweeter retaining post 254 extends from its flange end 254T toward its bottom end 254B and is in a coaxial arrangement with or parallel with the tweeter mounting post 252. A frictional holding force F2 is provided by leveraging the retaining post 254 against the mounting post 252 along their longitudinal, Y-axis, by means of a compression spring 256. The spring 256 is coupled to and leverages the bottom 254B of the retaining post 254 through a retaining ring 257 on its bottom end 254B and is coupled to and leverages the mounting post 252 against a notch in the mounting post 252 to exert the force F2 through the flange end 254T against the movable/adjustable tweeter holder 251 and top of the mounting post 252. Accordingly, the force F2 provides for frictional force created between the flange 254T, the tweeter holder 251 and the top of the mounting post 252 by applying the normal bias of the spring 256 through the retaining post 254 and the mounting post 252 to compress the tweeter holder 251 between the flange 254T and the top end of the mounting post 252. This structure allows sufficient movement and radial range for the tweeter holder 251 together with the tweeter 158 with respect to the tweeter mounting post 252 and the body 146. Such force and structure allow a stable position that exceeds the environmental forces, gravitational forces and vibration emanating from the audio signals generated by the speaker 200. As will be appreciated by one of ordinary skill in the art, the force F2 can be increased or decreased by the force of the spring 256.

Notably, the disclosed embodiments of FIG. 2 provide for a range of radial motion, effectively from −A2 to A2 degrees with the center of rotation C2 substantially coincident with the center point S2 of the tweeter 158. The disclosed embodiments of FIG. 2 also provide for minimal offset from the centers C2 and S2 through the tweeter's 158 effective range of motion −A2 to A2 degrees, as is illustrated by the effective degree of movement 0 to X2 in the x-axis direction and 0 to −Y2 in the y-axis direction. The reader will note that the offsets in the X2 and −Y2 are significantly smaller than the offsets X1 and −Y1 of the prior art embodiments. Accordingly, as the tweeter 158 is oriented and its position is adjusted, its distortion profile remains relatively constant to the woofer diaphragm 125. Such static position allows the designer to compensate for the tweeter 158 and its holder 251 and provide a higher quality audio production from the speaker 200.

Figure 4:
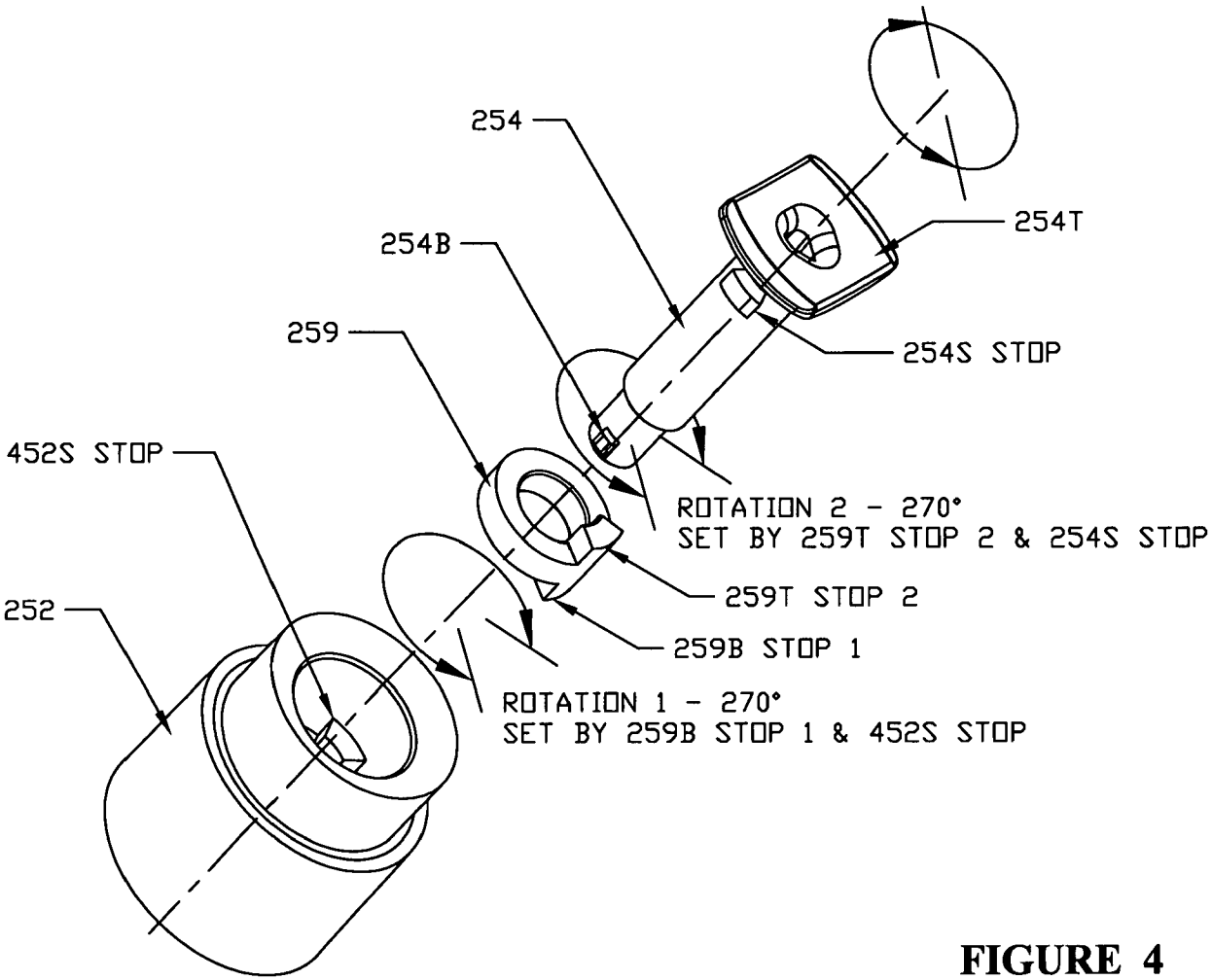
FIG. 4 illustrates a more detailed view of an embodiment that allows for limited axial rotation of the tweeter about the Y-axis of speaker.

FIG. 4 illustrates an embodiment that allows for limited axial rotation of the tweeter holder 251 and the tweeter 158 about the Y-axis of the speaker 200. Notably, the embodiments illustrated in FIG. 4 recognize that with axial movement of 360 degrees and radial movement range of 0 to A2 degrees, the user is able to fully orient the tweeter 158. Accordingly, the disclosed embodiments in FIG. 4 illustrate a configuration of stops 254S in combination with a ring 259, and stop 452S that provides for two axial actions that in sum exceed 360 degrees, but are ultimately limited to axial rotation of less than 720 degrees. In contrast, and referring back to FIG. 1, the reader will appreciate that the ball-socket design of the prior art embodiment, without a stop, allows the user to rotate the tweeter holder 151 without limit. Such unlimited configuration is likely to damage the electrical connection established by the wire leads (not shown) to the tweeter 158.

Shown in FIG. 4 is a more detailed embodiment of the tweeter retaining post 254. Namely, the reader is drawn to stop 254S formed or attached to the retaining post 254 and the ring 259 having a first stop 259B and a second stop 259T formed or attached to the ring 259. Aperture of ring 259 is configured to receive the retaining post 254 and allow the post 254 to axially rotate within the ring 259. Therefore, when the post 254 is inserted into ring 259, stop 254S is configured to cooperate and rotate with the stop 259T such that the rotation of stop 254S is limited in the negative and positive directions by the corresponding stop 259T. Accordingly, in this embodiment the rotational limit of retaining post 254 is limited by stop 259T and is less than 360 degrees.

In the disclosed embodiments, once the retaining post 254 meets its first limit of stop 259T, in either positive or negative direction, further rotational force applied to retaining post 254 will exert such force to ring 259 and its stop 259B, which will further have a range of motion limited by a stop 452S integral or attached to the mounting post 252. The mounting post 252 is configured with an aperture opening to accommodate the retaining post 254 therein and correspondingly, the lower portion of the retaining post 254 is tailored to accommodate mating to such opening. Similarly, the range of axial motion of the retaining post 254 and the ring 259 within the mounting post 252 is limited to the range of motion defined by the freedom of movement defined by the stop 259B and the stop 252S, which is less than 360 degrees. However, in the aggregate, the degree of motion defined by the stops 452S and 259B plus the degree of motion defined by the stops 259T and stop 254S, is greater than 360 degrees and less than 720 degrees. One of skill in the art could extend or contract this range by adding more stops and rings or by limiting the degree of motion at one or both of the pairs of cooperating stops. Note that in one embodiment, the combined degree of motion is 540 degrees, representing 270 degrees of motion defined by the stops 254S and 259T and another 270 degrees of motion defined by the stops 259B and 452S. Moreover, additional means for limiting the range can be achieved by manipulating the dimensions of the stops or placing multiple stops. In other embodiments, the axial degree of motion may be achieved by a thread design, where the thread allows the retaining post to have a predetermined range of movement. However, as described above, a threaded design may change the position of the tweeter with respect to the woofer, thus causing uncompensated and undesirable diffraction and distortion.

In the disclosed embodiments, the acoustic profile of the tweeter 250 does not impose a change from the point of view of the woofer, and the tweeter 250 edge profile does not change throughout its range of adjustment. Conversely, as the tweeter swivels in prior art "ball-in-socket" designs, typically the edge geometry around the tweeter radiating surface changes. Such configurations cause undesirable changes in the radiated sound pressure level due to diffraction at the corner geometry of prior art tweeter assemblies. More particularly, in the prior art swivel tweeters, the tweeter output frequency and phase response, woofer output frequency, phase response, tweeter-woofer sound pressure level and phase interactions change as the tweeter is swiveled. As the prior art tweeter position changes, the woofer sound field also changes, thereby making it difficult to design a compensating network for all tweeter positions. In the disclosed embodiments, the acoustic radiation emanating from the woofer cone "sees" the same tweeter assembly 250 acoustic profile independent of the direction and amount of tweeter 158 swivel. In the disclosed embodiments, the complex phase and amplitude relationships between the sound field of the woofer and/or midrange and the sound field of the tweeter 158 are held relatively constant for all tweeter assembly 250 positions permitting the design of a high performance compensating network which is independent of the swivel of the tweeter assembly 250.

As described, the embodiments disclosed herein provide substantial improvements over the prior art by holding the tweeter assembly 250 stable relative to the woofer and by maintaining the acoustic center of front surface of the tweeter 158 diaphragm in substantially the same position for all angles of rotation, without additional diffraction of the sound field from either the high or low frequency transducers. In addition to its virtual static positioning, to limit the undesirable diffraction, the embodiments disclose relatively continuous surface of the tweeter holder 251 and the waveguide 153. Reader will note that in the disclosed embodiments, as the tweeter holder 251 changes its position, from the woofer's perspective the profile of the tweeter assembly 250 remains constant due to the spherical structure of the tweeter holder 251 in combination with the waveguide 153, absence of sharp reflective structures in the tweeter holder 251 and the waveguide 153 and the lack of the axial or radial displacement X2, Y2 and A2. Accordingly, from the woofer's perspective, the tweeter assembly 250 remains static (even if changed by the user). Therefore, a sufficient compensating network can be designed for the disclosed coaxial assembly 200, despite the dynamic positioning of the tweeter 158.

Figure 3:
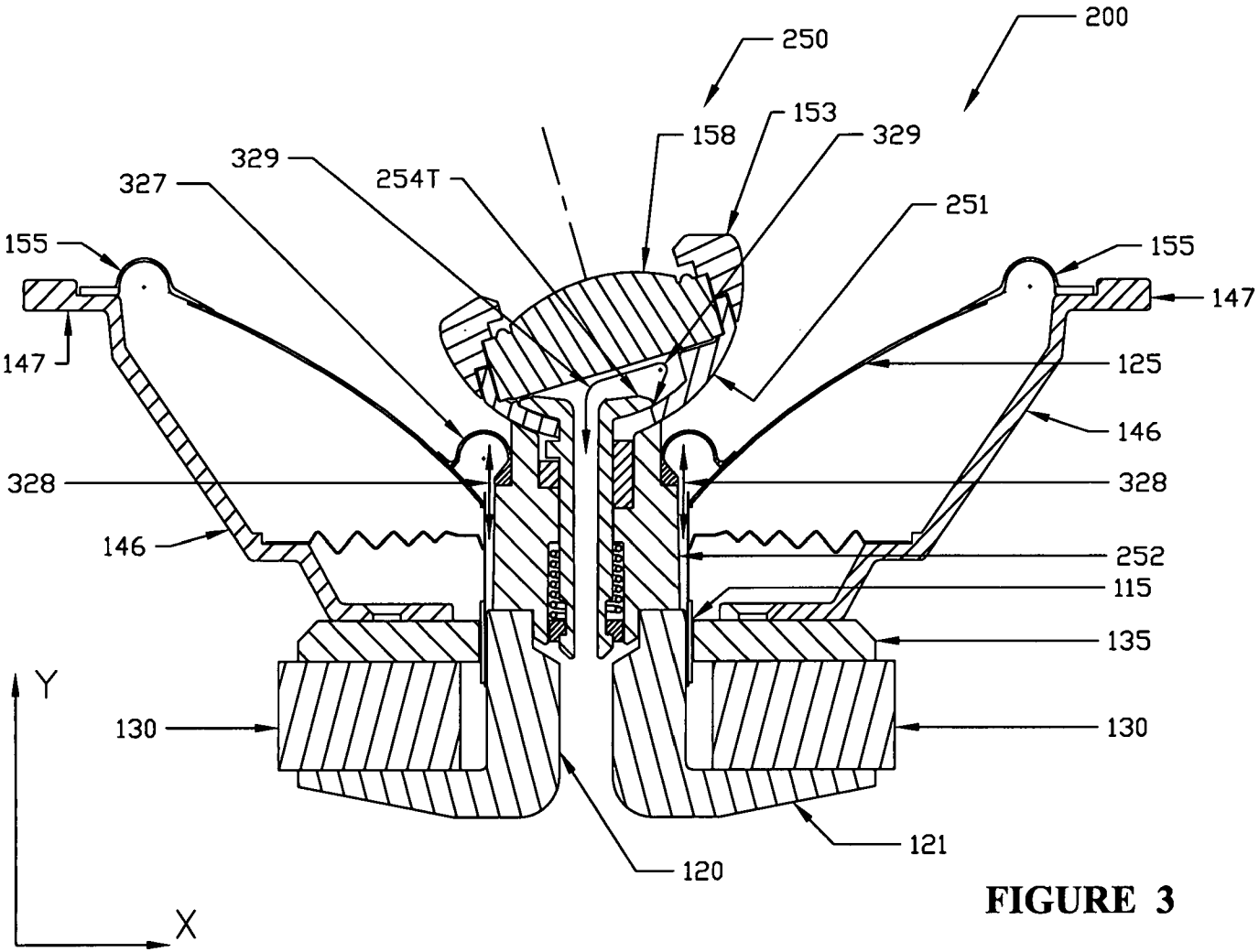
FIG. 3 is an illustrative embodiment of a barrier means limiting air flow generated by the woofer through the tweeter assembly.

FIG. 3 illustrates a detailed embodiment showing the use of a barrier means 327 to limit and/or eliminate air movement 328. As described above, the diaphragm 125 reproduces audio signals by moving air, which is in turn perceived by the listener. Where, such as in the embodiments described herein, the diaphragm 125 is part of a woofer and/or midrange audio transducer, it moves significant amount of air. Such air movement or air-flow naturally follows the path of least resistance. Accordingly, depending on the mechanical design of a speaker assembly, some part of the air moved by the diaphragm 125 flows through the assembly of a coaxial speaker. Such airflow is undesirable, as it may and often does result in air being pressurized on one side of a relatively small opening, which results in undesirable audio byproducts such as high frequency hissing or whistling coincident with lower bass or midrange notes. In the exemplary embodiment of FIG. 3, such airflow is represented by arrows 328 and 329. Absent means 327, as shown for exemplary illustration in the embodiment of FIG. 2, but present in the embodiment illustrated in FIG. 3, airflow 328 may and often does find its way through the path of least resistance throughout the assembly of the speaker 200; between the voice coil 115 and the mounting post 152. Similarly, if not restricted by the means 327 in combination with the flange 254T, bottom portion of the tweeter holder 251 and the top portion of mount post 252, the airflow 329 would produce undesirable audio byproducts coincident with lower bass or midrange notes. One of skilled in the art will appreciate that the means 327 is an airflow restrictor. It could be a membrane such as the surround 155 glued or attached to the surfaces proximate to its position at the speaker assembly; or a baffle means, or a restriction means of any kind that is designed to baffle, attenuate or eliminate airflow producing undesirable audio byproducts.

The description of the disclosed embodiments above is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

We claim:

1. An audio transducer assembly configured for positioning with respect to a placement surface, said assembly comprising:

an audio transducer coupled to a directionally adjustable body and further comprising a surface and a surface center;

said body configured for adjustably positioning said surface axially and radially such that said surface center remains substantially constant through its range of motion about an axis defined by a point of said surface and a point of said body;

at least one additional audio transducer mounted to a second body, wherein said second body is configured for positioning with respect to said placement surface;

a mounting post coupled to said second body and to said directionally adjustable body to position said directionally adjustable body with respect to said at least one additional transducer;

said directionally adjustable body axially and radially movable about said mounting post such that said point of said surface remains substantially constant through said range of motion about said axis.

2. The audio transducer assembly of claim 1 wherein said audio transducer is configured to generate a first range of audio frequencies and said at least one additional audio transducer is configured to generate a second range of audio frequencies.

3. The audio transducer assembly of claim 1 further comprising a retaining post positioned to engage said adjustable body between a flanged section of said retaining post and said mounting post.

4. The audio transducer assembly of claim 3 further comprising a spring compressed between said mounting post and said retaining post to apply a normally biased force of said spring through said flanged section of said retaining post in the direction of said adjustable body, thereby providing positioning stability of said adjustable body.

5. The audio transducer assembly of claim 3 further comprising at least one stop positioned between said retaining post and said mounting post to limit the axial range of movement of said retaining post and said adjustable body about said axis.

6. The audio transducer assembly of claim 3 further comprising a first stop positioned about said retaining post configured to axially rotate on a plane about a ring, thereby providing a first range of motion; said ring further configured to rotate on said plane about a second stop, thereby providing a second range of motion; said adjustable body, thereby limited to an axial range of motion limited to the sum of said first range of motion and said second range of motion.

7. The audio transducer assembly of claim 1, further comprising integrating said audio transducer into a device selected from the group consisting of a computing device, a radio, a disc player, a MP3 player, a vehicle, a marine vehicle, an audio player.

8. The audio transducer assembly of claim 1, further comprising a waveguide coupled to said directionally adjustable body, wherein said directionally adjustable body and said waveguide are configured to present a substantially static impression to said second body in a plurality of orientations.

9. An audio transducer assembly configured for positioning with respect to a placement surface, said assembly comprising:

an audio transducer means for producing audio sound coupled to a directionally adjustable body means for adjustably holding said audio transducer means comprising a surface and a surface center;

said body means configured for adjustably positioning said surface axially and radially such that said surface center remains substantially constant through its range of motion about an axis defined by a point of said surface and a point of said body means;

at least one additional audio transducer means for producing audio sound in a frequency range different from the other transducer means of said transducer assembly;

said at least one additional audio means mounted to a second body means for positioning said at least one additional audio means with respect to said placement surface;

a mounting means coupled to said second body means and to said directionally adjustable body means for positioning said directionally adjustable body means with respect to said at least one additional transducer means;

said directionally adjustable body means axially and radially movable about said mount means such that said point of said surface remains substantially constant through said range of motion about said axis.

10. The audio transducer assembly of claim 9 further comprising a retaining post means for engaging said adjustable body between a flanged section of said retaining post means and said mounting means.

11. The audio transducer assembly of claim 10 further comprising a force means compressed between said mounting means and said retaining post means for application of a normally biased force of said force means through said flanged section of said retaining post means in the direction of said adjustable body means thereby providing positioning stability of said adjustable body means.

12. The audio transducer assembly of claim 10 further comprising at least one stop means, positioned between said retaining post means and said mount post means, for limiting the axial range of movement of said retaining post means and said adjustable body about said axis.

13. The audio transducer assembly of claim 10 further comprising a first stop means fixed about said retaining post means configured to axially rotate on a plane about a first rotating means for providing a first range of motion; said first rotating means further configured for rotating on said plane about a second rotating means thereby providing a second range of motion; said adjustable body thereby limited to an axial range of motion limited to the sum of said first range of motion and said second range of motion.

14. The audio transducer assembly of claim 9, further comprising integrating said audio transducer into a device selected from the group consisting of a computing device, a radio, a disc player, a MP3 player, a vehicle, a boat, an audio player.

15. The audio transducer assembly of claim 9, further comprising a waveguide means for guiding an audio signal, said waveguide means coupled to said directionally adjustable body means, wherein said directionally adjustable body means and said waveguide means are configured to present a substantially static impression to said second body means in a plurality of orientations.

* * * * *